United States Patent [19]

Mas

[11] Patent Number: 4,649,639

[45] Date of Patent: Mar. 17, 1987

[54] METHOD OF BUILDING TOROIDAL CORE ELECTROMAGNETIC DEVICE

[75] Inventor: Joseph Mas, Morristown, N.J.

[73] Assignee: Allied Corporation, Morris Township, Morris County, N.J.

[21] Appl. No.: 711,426

[22] Filed: Mar. 13, 1985

Related U.S. Application Data

[60] Division of Ser. No. 380,657, May 21, 1982, Pat. No. 4,524,342, which is a continuation-in-part of Ser. No. 334,751, Dec. 12, 1981, abandoned.

[51] Int. Cl.[4] ..... H01F 7/06

[52] U.S. Cl. ..... 29/605; 336/182; 336/219; 336/223; 336/229; 336/233

[58] Field of Search ..... 29/605, 609; 336/229, 336/223, 175, 180, 182, 212, 219

[56] References Cited

U.S. PATENT DOCUMENTS

| | | | |
|---|---|---|---|
| 1,548,388 | 8/1925 | Shackelton | 336/229 X |
| 2,907,968 | 10/1959 | Thurk | 336/221 |
| 2,947,960 | 8/1960 | Frederickson | 336/212 |
| 3,032,729 | 5/1962 | Fluegel | 336/229 X |

FOREIGN PATENT DOCUMENTS

| | | |
|---|---|---|
| 937184 | 12/1955 | Fed. Rep. of Germany . |
| 2205072 | 8/1973 | Fed. Rep. of Germany . |
| 2008858 | 6/1979 | United Kingdom . |

*Primary Examiner*—Carl E. Hall

*Attorney, Agent, or Firm*—Ernest D. Buff; Gerhard H. Fuchs

[57] ABSTRACT

An electromagnetic apparatus is provided with a magnetic core and a segmented electrical winding. The core has an enclosed trunk defining a central opening. At least three coil sections of the electrical winding encircle the trunk and are circumferentially spaced about the periphery of the core.

5 Claims, 10 Drawing Figures

FIG. 4
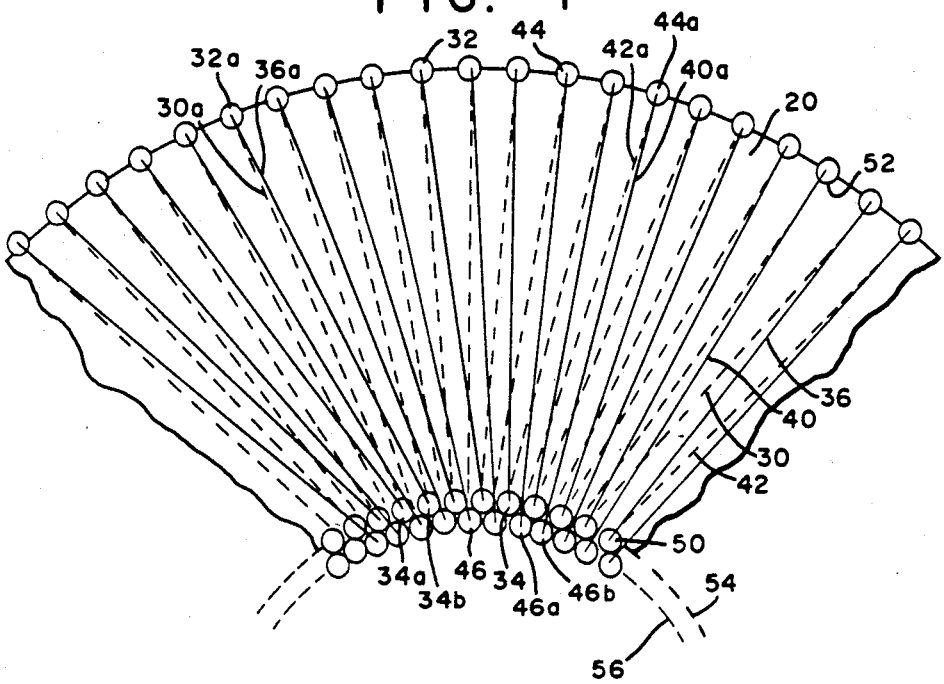
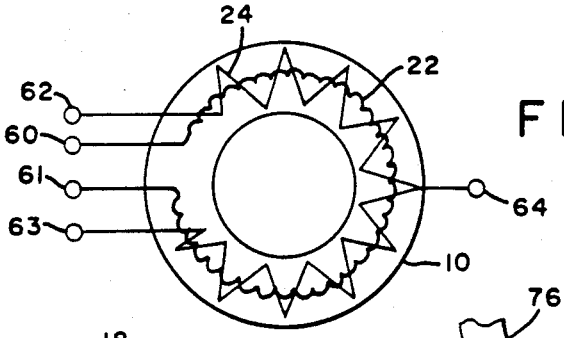
FIG. 5
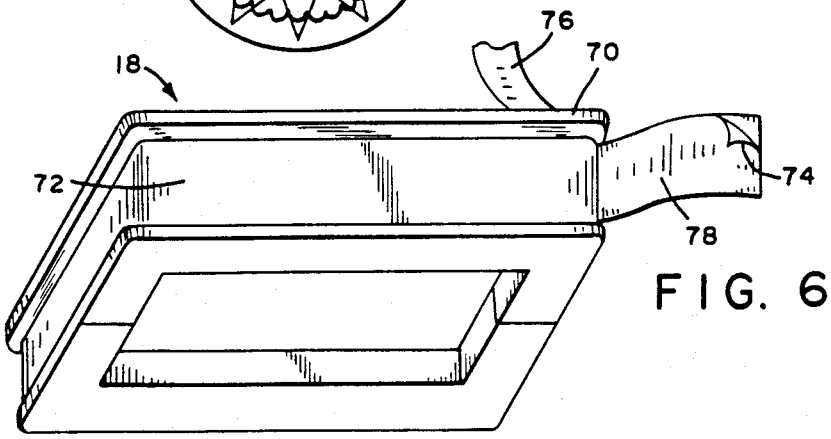
FIG. 6

METHOD OF BUILDING TOROIDAL CORE ELECTROMAGNETIC DEVICE

DESCRIPTION

This application is a divisional of application Ser. No. 380,657 filed May 21, 1982 which was a continuation-in-part of my now abandoned application Ser. No. 334,751, filed Dec. 12, 1981, for Toroidal Core Electromagnetic Device. Application Ser. No. 380,657 issued June 18, 1985 as U.S. Pat. No. 4,524,342.

BACKGROUND OF THE INVENTION

1. Field of the Invention

This invention relates to electromagnetic apparatus for use in electrical induction devices such as inductors, transformers, motors, generators and the like.

2. Description of the Prior Art

In the manufacture of shell-type transformers, the primary and secondary windings are formed into a common ring having a central opening or window. Two or more rings of magnetic core material are cut open, threaded through the winding window and closed, so that the rings of core material are distributed about the periphery of and encircle the windings. One of the problems with shell-type transformers is the difficulty of cutting and shaping the core material without degrading its magnetic properties. To overcome this problem, coretype transformers have been proposed wherein the core is formed into a ring, which is encircled by two or more groups of primary and secondary windings distributed around the periphery of the ring. Such core-type transformers are bulky and inefficient in terms of material utilization. Moreover, in transformers of the types described above, heat developed by the windings and core during operation oftentimes results in a temperature rise of more than 50° C., increasing the deterioration rate of solid insulating materials in the core and windings as well as the liquid coolant in which the transformer is immersed. For these reasons, transformers of the type described generally result in higher purchase and maintenance costs and lower operating efficiencies than are considered desirable.

SUMMARY OF THE INVENTION

The present invention provides an electromagnetic apparatus that is lighter, more compact, easier to build and far more efficient and reliable in operation than previous transformers of the shell or core type. Generally stated, the apparatus includes a magnetic core having an enclosed trunk defining a central opening, and a primary winding having at least three primary coil sections encircling the trunk and circumferentially spaced about the periphery of the core.

In addition, the invention provides a method for making an electromagnetic apparatus comprising the steps of winding a plurality of layers of magnetically permeable material to form a magnetic core having an enclosed trunk defining a central opening; winding a plurality of layers of electrically conductive material on said core, the layers passing through the central opening and encircling the trunk to form thereon a primary coil section; and winding at least a second and a third primary coil section on the core, each primary coil section being formed of a plurality of layers of electrically conductive material passed through the central opening to encircle the trunk, and being circumferentially spaced about the periphery of the core.

Further, the invention provides an electromagnetic apparatus having a segmented secondary winding. The segmented secondary winding includes a plurality of cleft links that encircle the coil and the primary coil sections and are interconnected to provide a spiral current path. Each of the cleft links has a portion passing through the central opening of the coil and is circumferentially spaced about the periphery thereof.

The apparatus of this invention has significant structural features. Less material is required by the toroidal core for a given power capacity. The magnetizing current is reduced, since the core has no air gap. A toroidal core is readily wound from strip material, and particularly adapted to utilize amorphous metal strip. The cleft links are readily manufactured or cast and press fit during assembly to form an outer shell that strengthens the apparatus and protects the core and windings within. Sectionalized arrangement of the primary and secondary coils improves heat dissipation, reducing temperature rise. As a result, the electromagnetic apparatus of the present invention has lower size, weight, and cost and higher operating efficiency and reliability than previous electromagnetic devices.

BRIEF DESCRIPTION OF THE DRAWINGS

The invention will be more fully understood and further advantages will become apparent when reference is made to the following detailed description of the preferred embodiments of the invention and the accompanying drawings, in which:

FIG. 4 is a partial schematic illustration of the secondary winding of the electromagnetic device of FIG. 1;

FIG. 5 is a schematic illustration of the secondary winding of the electromagnetic device of FIG. 1;

FIG. 6 is a perspective view of one of the primary coils of the electromagnetic device of FIG. 1;

DESCRIPTION OF THE PREFERRED EMBODIMENT

Figure 1:
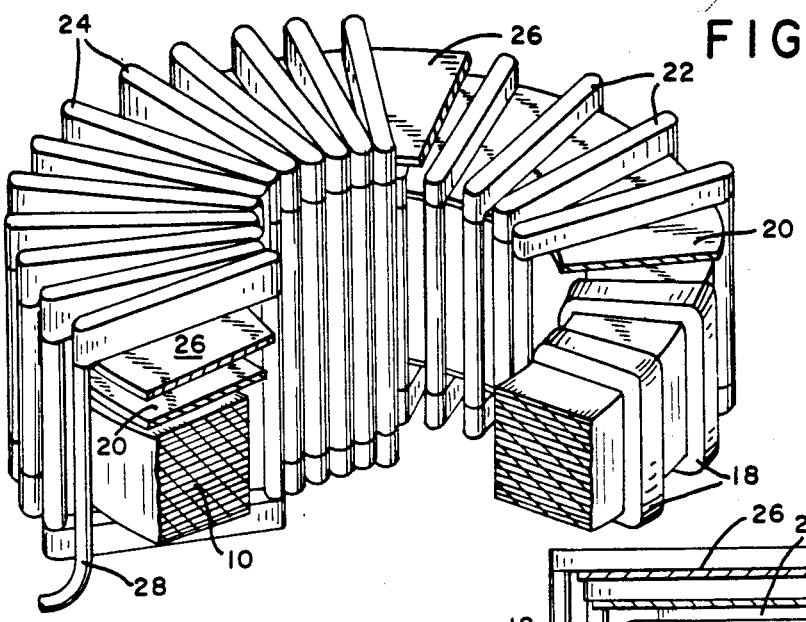
FIG. 1 is an isometric view of an electromagnetic device, portions broken away for illustrative purposes, according to the teachings of the present invention.
Figure 2:
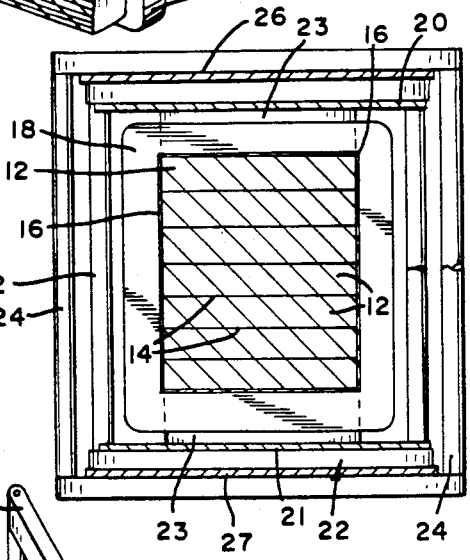
FIG. 2 is a cross-sectional view taken through the trunk of the electromagnetic device of FIG. 1.

Referring to FIGS. 1 and 2, there is illustrated an electromagnetic apparatus adapted to operate as a transformer having a 25 KVA rating although, obviously, other ratings are contemplated. Magnetic core 10 has a plurality of stacked toroids 12. Each of the toroids 12 are formed of coiled, magnetically permeable, strip material. In the embodiment shown, seven stacked toroids 12 are employed, each having a height of approximately one inch and an inside diameter of 8.6 inches and an outside diameter of 14.3 inches. It will be appreciated, however, that the number of toroids stacked and their respective height and diameters can be altered, depending upon the required efficiency, volume, requirements to reduce eddy currents, power ratings, frequency, etc. Toroids 12 are separated from each other by annular insulators 14 which may be formed of any suitable insulating material such as thermosetting or thermoplastic material, glass cloth, fiberglass, polycarbonates, MICA, CAPSTAN, LEXAN, fish paper and the like, having the required flexibility, dielectric strength, toughness and stability at the designed operating temperature of the magnetic core, normally in the vicinity of 130° C. Insulating layers 14 are in the form of a flexible film having a thickness of about ½ mil and inside and outside diameters substantially matching that of the toroids 12. It will be appreciated that the insulating layers 14 need not be continuous but may be in the form of spaced elements, if desired. Also, the insulating layers may, instead of being separate, be deposited by spraying, painting, etc. Moreover, the core 10 can have a configuration other than toroidal, for example, an oval, rectangular, square or the like configuration, and a molded rather than wound construction. A similar insulating wrapping 16 is shown herein surrounding core 10 on all external sides, wrapping it in an insulating cocoon.

The coiled strip material of toroids 12 is composed of magnetically soft material. Such material desirably has the following combination of properties: (a) low hysteresis loss; (b) low eddy current loss; (c) low coercive force; (d) high magnetic permeability; (e) high saturation value; and (f) minimum change in permeability with temperature. Conventionally employed magnetically soft material in strip form, such as high-purity iron, silicon steels, iron/nickel alloys, iron/cobalt alloys and the like, are all suitable for use in the practice of the present invention. Particularly suitable, however, is strip material of amorphous (glassy) magnetic alloys which have recently become available. Such alloys are at least about 50% amorphous, as determined by x-ray diffraction. Such alloys include those having the formula ($M_{60-90}T_{0-15}X_{10-25}$), wherein M is at least one of the elements iron, cobalt and nickel, T is at least one of the transition metal elements, and X is at least one of the metalloid elements of phosphorus, boron and carbon. Up to 80 percent of the carbon, phosphorus and/or boron in X may be replaced by aluminum, antimony, beryllium, germanium, indium, silicon and tin. Used as cores of magnetic devices, such amorphous metal alloys evidence generally superior properties as compared to the conventional polycrystalline metal alloys commonly utilized. Preferably, strips of such amorphous alloys are at least about 80% amorphous, more preferably yet, at least about 95% amorphous.

The amorphous magnetic alloys of core 10 are preferably formed by cooling a melt at a rate of about $10^5$ to $10^{6}$° C./sec. A variety of well-known techniques are available for fabricating rapid-quenched continuous strip. When used in magnetic cores for electromagnetic induction devices, the strip material of core 10 typically has the form of wire or ribbon. This strip material is conveniently prepared by casting molten material directly onto a chill surface or into a quenching medium of some sort. Such processing techniques considerably reduce the cost of fabrication, since no intermediate wire-drawing or ribbon-forming procedures are required.

The amorphous metal alloys of which core 10 is preferably composed evidence high tensile strength, typically about 200,000 to 600,000 psi, depending on the particular composition. This is to be compared with polycrystalline alloys, which are used in the annealed condition and which usually range from about 40,000 to 80,000 psi. A high tensile strength is an important consideration in applications where high centrifugal forces are present, such as experienced by cores in motors and generators, since higher strength alloys allow higher rotational speeds.

In addition, the amorphous metal alloys used to form core 10 evidence a high electrical resistivity, ranging from about 160 to 180 microhm-cm at 25° C., depending on the particular composition. Typical prior art materials have resistivities of about 45 to 160 microhm-cm. The high resistivity possessed by the amorphous metal alloys defined above is useful in AC applications for minimizing eddy current losses, which in turn, are a factor in reducing core loss.

A further advantage of using amorphous metal alloys to form core 10 is that lower coercive forces are obtained than with prior art compositions of substantially the same metallic content, thereby permitting more iron, which is relatively inexpensive, to be utilized in core 10, as compared with a greater proportion of nickel, which is more expensive.

Each of the toroids 12 may be formed by winding successive turns onto a mandrel (not shown), keeping the strip material under tension to effect a tight formation. The number of turns is chosen depending upon the desired size of each toroid 12. The thickness of the strip material of toroids 12 is preferably in the range of 1 to 2 mils. Due to the relatively high tensile strength of the amorphous alloy used herein, strip material having thickness of 1–2 mils can be used without fear of breakage. It will be appreciated that keeping the strip material relatively thin increases the effective resistivity since there are many boundaries per unit of radial length which eddy currents must pass through.

A primary winding is shown herein as having at least 3 primary coil sections 18 encircling the trunk of core 10 and circumferentially spaced about the periphery thereof. The illustrated embodiment contains eighteen coils 18, formed of 84 turns of insulated strip aluminum approximately one inch wide and 0.005 inch thick. This arrangement provides a 6,000 volt primary, although other ratings are contemplated. The number of primary coil sections 18 employed can vary depending on the inside diameter of coil 10 the width and thickness of strip material used in the soil sections, the number of turns per section and the desired spacing between sections. Preferably, the number of primary coil sections ranges from about 10 to 30, and more preferably from about 16 to 20. Moreover, coil 18 may vary dimensionally or may employ a round, square or other cross-section depending upon the voltage and power rating, available space, etc.

Annular spacers 20 and 21, shown on either side of coils 18, may be formed of any suitable insulating material having mechanical and dielectric strength sufficient to withstand the transformer environment. Phenolic or materials described in connection with insulating layer 14 may be used in spacers 20 and 21. Each of the inside and outside diameters of annular spacers 20 and 21 is sufficient to completely overlay coils 18. Disposed adjacent to spacers 20 and 21 are eighteen ribs 23. As illustrated hereinafter, annular spacers 20 and 21 are identical and have a series of angularly spaced notches on the inside and outside perimeter for aligning secondary windings as described in more detail hereinafater. It will be understood that the electromagnetic apparatus of the invention can be used as an inductance, without a secondary windings or as a transformer or other electromagnetic device that utilizes secondary windings.

In accordance with the present invention, the electromagnetic apparatus has a segmented secondary winding shown herein as a plurality of turns of inner conductors 22 and outer conductors 24. The conductors 22 and 24 are separated by annular spacers 26 and 27 on either side of conductors 22. Annular spacers 26 and 27 may be formed of an insulating material similar to that of spacers 20 and 21 and have an inside and outside diameter sized to fit the space within conductors 24. Conductors 22 and 24 form spiral or helical windings, one terminal of conductors 24 being shown as lead 28.

Figure 3:
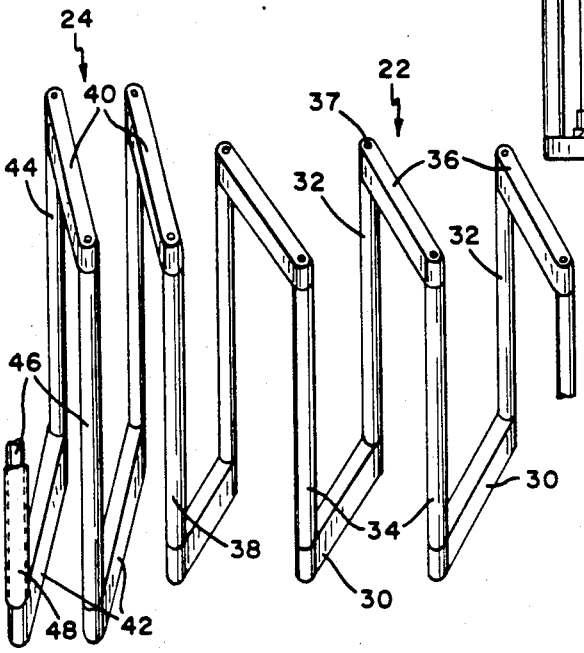
FIG. 3 is a perspective view of windings removed from the electromagnetic device of FIG. 1 and stretched apart for illustrative purposes.

Referring to FIG. 3, there is shown a perspective view of a portion of conductors 22 and 24. As illustrated, the conductors 22 and 24 are removed from their magnetic core and stretched apart to reveal internal details. Conductors 22 and 24 are made of aluminum and provide a spiral current path. This current path is formed from a cleft link shown herein as a U-shaped member comprising bottom piece 30, first leg 32 and second leg 34. Legs 32 and 34 are ½ inch in diameter and bottom piece 30 has a rectangular cross-section one inch high and ½ inch wide, although these shapes and the net cross-sectional areas can vary according to the current rating. The circuit of conductors 22 is effected by jumpers 36 which connect between legs 32 and 34. Legs 32 and 34 have both ends tapered and sized to force fit into tapered holes 37 at the ends of elements 30 and 36. Preferably, each of the ends of legs 32, 34 and holes 37 have substantially the same angle of taper, whereby the contact area and contact pressure of the mating surfaces thereof are maximized. These joints can be splined or serrated to improve electrical conductivity and mechanical rigidity.

Conductor 24 is formed of a cleft link comprising bottom piece 42, first leg 44 and second leg 46, each having the same cross-sectional dimensions as elements 30, 32, 34, respectively, but having different lengths. The lengths are chosen to allow a snug fit for conductors 22 around spacers 20 and 21 and for conductors 24 around spacers 26 and 27. In this embodiment, bottom pieces 30 and 42 will be aligned radially and are therefore shorter than their counterparts, jumpers 36 and 40, respectively.

It will be observed that the connection between conductors 22 and 24 is made by vertical rod 38, which is of length intermediate that of legs 34 and 46. The length brings the upper end of rod 38 even with legs 46 of conductors 24, allowing conductors 24 to fit around the beginning (not shown this view) of conductors 22 and form a nested structure. It will be noted that legs 46 can be sheathed by an insulating sleeve 48 to prevent shorting between adjacent turns of conductors 24.

In FIGS. 4 and 5, there is illustrated schematically, the secondary winding of FIG. 3. FIG. 4 depicts spacer 20 (and the underlying spacer 21 hidden from view), as having a plurality of evenly and angularly spaced notches, including inner notches 50 and outer notches 52. Second legs 34 lie along inner perimeter 54, while second legs 46 lie innermost along perimeter 56. The upper jumpers 36 and 40, shown in full, and the lower pieces 30 and 42, shown in phantom, effect the previously described connections. The foregoing structure can be more readily understood with reference to FIG. 5, which shows, schematically, the inner or primary conductors 22 spiraling around core 10 and connecting to output terminals 60 and 61. The outer or secondary conductors 24 also spiral around core 10 and connect to terminals 62 and 63 and center tap 64.

This spiraling of the secondary conductors 24 is depicted by the schematic of FIG. 4. For example, the spiraling of conductors 22 is accomplished by leg **34*a* which descends and connects to outwardly extending piece 30*a* and thence to leg 32*a* and jumper 36*a*. Jumper 36*a* connects to the next succeeding link, that is, leg 34*b*. This describes one complete turn which, in this fashion, proceeds and envelops the entire core. The spiraling of outer conductors 24 may be understood by considering inner leg 46*a* which connects to a bottom piece 42*a* and thence to outer leg 44*a*. Jumper 40*a* next connects across to a succeeding leg 46*b*. The foregoing describes one complete turn which can proceed to again envelope the core and windings 22**.

Inner legs 46 touch each other and inner legs 34. The latter fit into the junctures between adjacent ones of legs 46. However, legs 34 are spaced and legs 46 have insulating sleeves so there is no short circuiting of turns.

The foregoing secondary has split windings 22 and 24, each having 26 turns, and each designed to produce 120 volts at 60 Hertz (240 volts total). Of course, other output voltages and frequencies are possible. It is contemplated that items 30, 32 and 34, as well as items 38, 42 and 44, will be pre-assembled; and items 30, 32 and 34 will be fitted into corresponding notches 50 and 52. Subsequently, jumpers 36 can be placed across the appropriate pair of legs 32 and 34 and individually or simultaneously pressed into place. Thereafter, elements 38, 42 and 44 can be fitted into or near notches 50 and 52, and jumpers 40 may be positioned across the appropriate legs 44 and 46 and then individually or simultaneously pressed into position.

Figure 10:
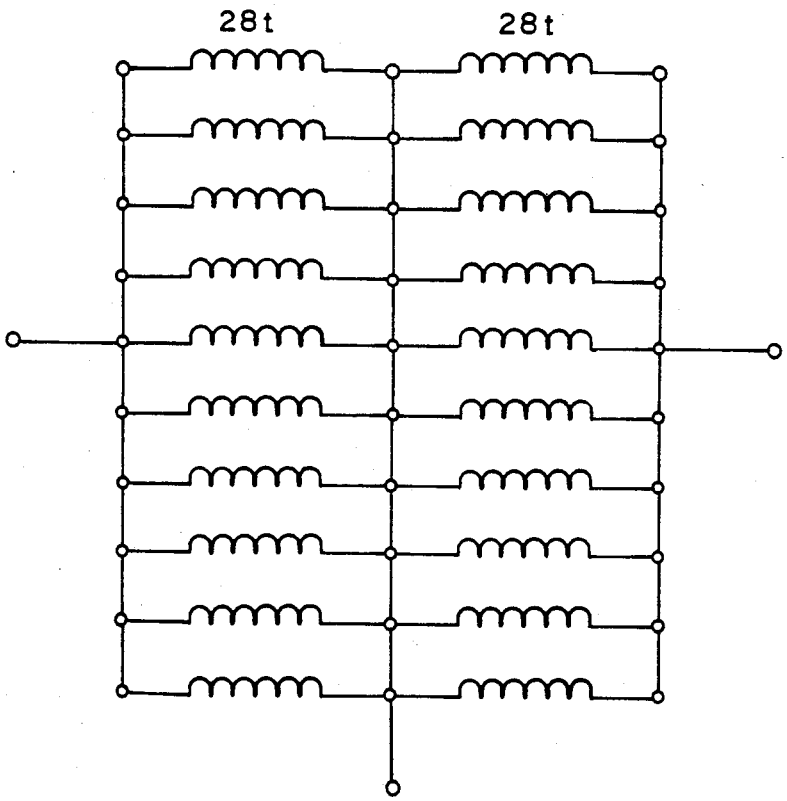
FIG. 10 is a schemtic electrical diagram of a segmented secondary having a plurality of sections each of which is comprised of a plurality of layers of strip material.

Alternatively, as shown in FIG. 10, the segmented secondary can be comprised of a plurality of sections of wound ribbon connected in a series parallel manner. In general, the number of sections ranges from 10 to 30, the number of turns of ribbon used in each section ranges from 10 to 100, the ribbon width ranges from 0.5 to 3 cm and the ribbon thickness ranges from 0.025 to 2 cm. The embodiment shown in FIG. 10 has 20 sections of 28 turns, each wound with ½" (1.27 cm) wide, 0.040" (0.1016 cm) thick ribbon. Twenty sections of the ribbon are connected in series parallel, as shown in FIG. 10. In the embodiment of FIG. 10, there are 10 sections in parallel for a cross-section area of 0.2" (0.508 cm).

Figure 7:
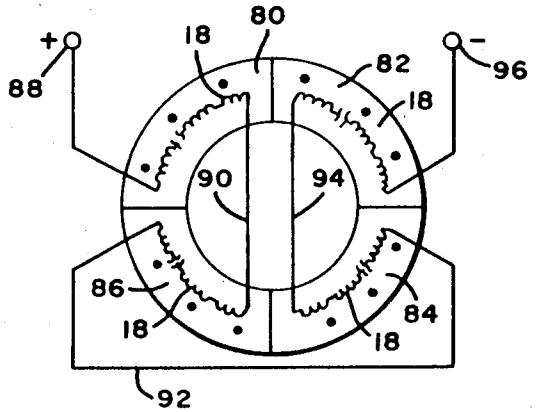
FIG. 7 is a schematic illustration of the interconnection of primary coils of the electromagnetic device of FIG. 1.

Referring to FIGS. 6 and 7, the primary coils of the transformer of FIG. 1 are illustrated. In FIG. 6, an individual coil 18 is shown consisting of an split bobbin 70 onto which aluminum strip 72 is wound. Use of bobbin 70 is optional, since individual coil 18 can be self supporting. Strip 72 has an insulating layer 74 which prevents shorting between adjacent turns. Connection to the coil 18 is made through inner end 76 and outer end 78 of strip 72. The bobbin is essentially a channel-like member following a rectangular track and having a center hole sized to fit about the core (core 10 of FIG. 1). In this embodiment, eighteen coils are used, each having eighty-four turns of strip material 72. Accordingly, for a 6,000 volt primary, each of the coils 18 will have a voltage drop of about 333 volts, a modest value. However, the potential difference between the beginning and ending coil is 6,000 volts and presents design limitations if adjacent. It is preferred, therefore, that the coils 18 be wired inconsecutively and grouped as illustrated in FIG. 7. As shown herein, coils 18 are grouped into four quadrants 80, 82, 84 and 86, positioned in that order, the coils in each quadrant being serially connected so they combine their voltages constructively. The coils 18 of quadrant 80 are connected between terminal 88 and lead 90. The coils of quadrant 86 connect between 90 and 92. The coils 18 of quadrant 84 connect between leads 92 and 94. Coils 18 of quadrant 82 are connected between leads 94 and terminal 96. All of the foregoing connections produce constructive combinations of the voltages of each quadrant. Significantly, the highest potential distance between the terminals of coils 18 exists between terminals 96 and 86, but these terminals are spaced by about 180 degrees. Accordingly, there is not an excessive electric field tending to cause a dielectric breakdown. Moreover, since the individual coils 18 have eighty-four turns over which 333 volts are dropped, the interlayer potential between each turn of coil 18 is only about four volts. This modest potential difference is easily accommodated by the insulating layer 74. In embodiments where coils 18 are composed of conventional layers of many turns of insulated wire, the potential difference between successive layers would be relatively higher.

The electromagnetic apparatus described above is a power distribution transformer having a load loss of 240 watts at a 25 KVA capacity and weighing a total of 360 lbs. including case and oil. With an amorphous alloy core weighing 165 lbs and operating at 13.5 kilogauss, the transformer has a core loss of only 16 watts. A distribution transformer of the same capacity and load loss using prior art cruciform design of the same amorphous alloy at the same flux density would weigh a total of 720 lbs. The core would weight 260 lbs and would have a loss of 38 watts. Conventional 25 KVA transformers in current use have silicon-iron cores operating at 16 to 17 kilogauss and have load losses of 300 to 500 watts and core losses of 90 to 113 watts. With power companies willing to pay a bonus for lower core losses, and to a lesser extent for lower load losses, the most recent 25 KVA design using the best grain oriented silicon-iron core weighs 400 lbs and has core loss of 87 watts and a load loss of 250 watts. It is evident from the foregoing that a transformer constructed in accordance with the present invention would have the highest loss bonus and the lowest material contents.

Figure 8:
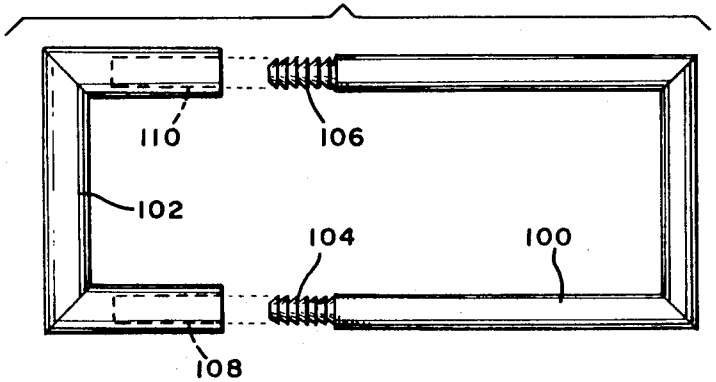
FIG. 8 is a side view of another cleft link and jumper which is an alternate to those shown in FIG. 3.

Referring to FIG. 8, an alternate link and jumper is shown as link 100 and jumper 102. Link 100 is a circular rod formed into a U-shaped member having right angle bends. Its tips 104 and 106 have inwardly directed teeth or serrations. Tips 104 and 106 are sized to fit holes 108 and 110, respectively, in jumper 102. Jumper 102 is a U-shaped bracket which may, in some embodiments, be formed of hollow tubes but is, in this embodiment, solid at its midsection. Jumpers 102 can replace jumpers 36 or 40 (with the appropriate dimensional adjustment) of FIG. 3. Link 100 can replace the links composed of elements 30, 32 and 34 and the links composed of elements 42, 44 and 46 (with the appropriate dimensional adjustments). It will be appreciated that in other embodiments, the connection between link 100 and jumper 102 can be effected with any approppriate fastener, including nuts and bolts.

Figure 9:
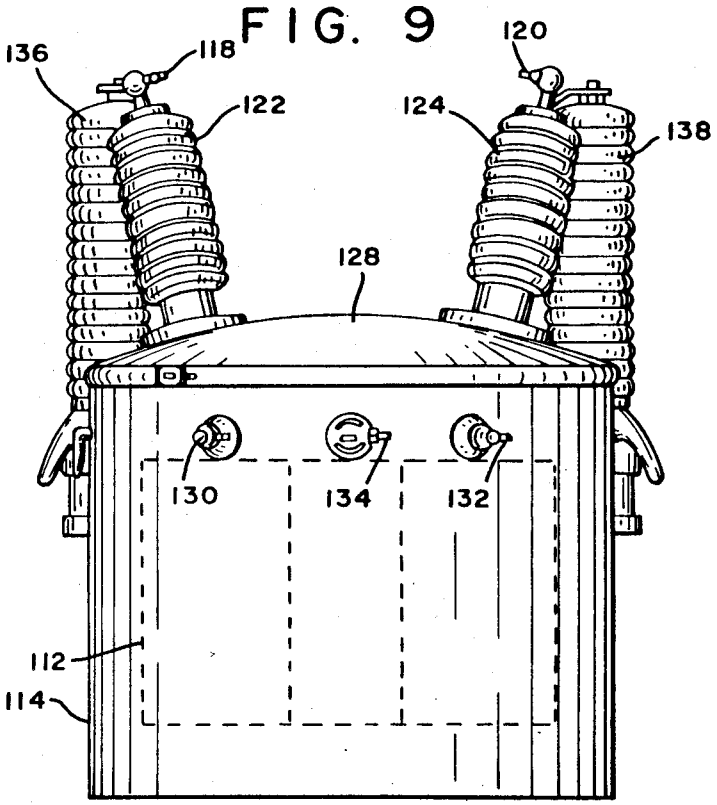
FIG. 9 is a front view of the finished transformer.

Referring to FIG. 9, a finished product is illustrated, the transformer of FIG. 1 being illustrated in phantom as assembly 112. It will be appreciated that since the assembly 112 has effectively a strong metal exoskeleton, (conductors 22 and 24 of FIG. 1), it is therefore highly resistant to shock. Assembly 112 may rest on any appropriate platform or on struts, which leave the bottom of assembly 112 open for cooling purposes. Assembly 112 is shown mounted within shell 114 which may be filled with a cooling medium, such as oil. Since transformer 112 is a relatively open structure exposing much of core 10, cooling is greatly facilitated. In particular, there are significant spaces between coils 18 (FIG. 1), so that oil can pass through conductors 22 and 24 and intimately contact core 10. A high voltage primary connection is made through terminals 118 and 120 mounted atop high voltage insulating standoffs 122 and 124, respectively. Standoffs 122 and 124 are mounted on cover 128 and provide through internal conductors (not shown) continuity to transformer 112. Cover 128 seals shell 114 and prevents leakage of its oil. Secondary connections are shown herein as output terminals 130 and 132 and 134, which correspond to terminals 62, 64 and 60 of FIG. 5. It will be noted that the overall height of the assembly of FIG. 9 is relatively small due to the, toroidal construction of the transformer. Lightning arrestors 136 and 138 can bypass dangerous over-voltages from terminals 118 and 120 to the shell 114, which is grounded.

It is to be appreciated that various modifications may be implemented with respect to the above-described preferred embodiments. The current and voltage rating may be altered by changing the size and the number of turns of the conductors in the windings. A variety of containers may be used to house the transformer. The sequence for connecting primary windings may be changed, especially for low voltage applications. While oil coolants are mentioned in some embodiments, different liquid and gaseous coolants may be substituted. The primary is shown enveloped by the secondary; but this arrangement of the windings may be reversed in other embodiments. Moreover, the function of primary and secondary may be reversed. The various fixtures shown for supporting and insulating the windings may be reshaped and made of alternate materials depending upon the desired dielectric strength, weight and structural integrity thereof. Although aluminum conductors are described herein, alternate conducting materials may be employed depending upon the weight, resistivity and other requirements.

Having thus described the invention in rather full detail, it will be understood that these details need not be strictly adhered to but that various changes or modifications may suggest themselves to one skilled in the art, all falling within the scope of the invention as defined by the subjoined claims.

What is claimed is:

1. A method of building an electromagnetic apparatus comprised of a magnetic core having an enclosed trunk defining a central opening, and primary and secondary windings encircling said trunk, the secondary winding being segmented and includes a plurality of cleft links (22, 24) encircling said core which are interconnected to provide a spiral current path, each of said clift links having a portion passing through said central opening of said core and being circumferentially spaced about the periphery thereof, and the method characterized by the steps of:

building said secondary winding by encircling said core with said plurality of said clift links as a sequence of generally U-shaped members, each having a first leg (32, 44), a second leg (34, 46) and a bottom piece (30, 42) with the ends of said legs having ends constructed to engage jumpers at engaging holes thereof;

electrically connecting the first leg of each of the members to the second leg of the succeeding one of the members by pressfit engaging the ends of the legs at engaging holes of corresponding connecting jumpers; and assembling said primary winding as a sectionalized primary winding having at least three primary coil sections (18) encircling said trunk in a manner circumferentially spaced about the periphery of said core (10), with each of said primary coil sections being a coiled, electrically conductive strip (72) having on at least one side thereof an insulating layer (74).

2. A method of building an electromagnetic apparatus as recited in claim 1, wherein said sectionalized primary winding includes a plurality of turns of ribbon.

3. A method of building an electromagnetic apparatus as recited in claim 2, wherein each of said sections encircling said core is connected in serial parallel to provide said spiral current path.

4. A method of building an electromagnetic apparatus as recited in claim 2, wherein the number of said sections ranges from about 10 to about 30.

5. A method of building an electromagnetic apparatus as recited in claim 4, wherein each of said sections has from 10 to 100 turns of ribbon that is 0.5 to 3 cm thick and 0.025 to 2 cm wide.

* * * * *